US006264490B1

(12) United States Patent
Lemke et al.

(10) Patent No.: US 6,264,490 B1
(45) Date of Patent: Jul. 24, 2001

(54) ELECTRICAL CONNECTOR HAVING FEMALE CONTACT

(75) Inventors: Timothy A. Lemke, Dillsburg; Timothy W. Houtz, Etters, both of PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/444,956

(22) Filed: Nov. 22, 1999

(51) Int. Cl.[7] ..... H01R 4/50
(52) U.S. Cl. ..... 439/342
(58) Field of Search ..... 439/342, 259–270, 439/347, 79, 78

(56) References Cited

U.S. PATENT DOCUMENTS 4,519,660 * 5/1985 Ichimura et al. ..... 439/342
5,044,973 9/1991 Noda et al. ..... 439/296
5,649,836 7/1997 Kashiwagi ..... 439/342
5,704,800 1/1998 Sato et al. ..... 439/342

FOREIGN PATENT DOCUMENTS

WO98/15989 4/1998 (WO) .

* cited by examiner

*Primary Examiner*—Khiem Nguyen
(74) *Attorney, Agent, or Firm*—Perman & Green, LLP

(57) ABSTRACT

An electrical connector comprising electrical contacts and a housing. The electrical contacts are connected to the housing. The housing comprises a first housing member and a second housing member movably connected to the first housing member. The second housing member comprises holes for allowing contact pins of an electrical component to be inserted into the housing. The housing also comprises contact preload projections. The contact preload projections contact the electrical contacts to preload the electrical contacts and, when the contact pins are inserted into the holes, the contact preload projections contact the contact pins to form a strain relief support for the contact pins.

21 Claims, 4 Drawing Sheets

ELECTRICAL CONNECTOR HAVING FEMALE CONTACT

BACKGROUND OF THE INVENTION

1. Field of the Invention

The present invention relates to electrical connectors and, more particularly, to a socket connector for receiving terminals from a mating component.

2. Brief Description of Earlier Developments

U.S. Pat. No. 5,044,973 discloses an electrical connector for receiving male contacts of an electrical component. The connector has preload pins to preload arms of electrical contacts of the connector in an open position. U.S. Pat. No. 5,704,800 discloses an inner wall projection of a housing used to preload a contact arm.

One of the problems in the design of high pin count connectors is the amount of force that is required to mate the connectors. A minimum amount of normal force (approx. 30 grams per contact) is required for a reliable contact interface for gold plated contacts. Usually most applications limit the total mating forces to less than 10 lb for repetitive operations. This means that there is finite limit, based on the sliding friction alone, to the maximum pin count for a standard connector; around 450 contacts at the minimum normal force. However, this does not take into account the increased friction at the initial part of the contact mating cycle; when the contact is first opened. This additional force approximately doubles the initial forces which further limits the pin count. In other words, even less than 450 contacts will exceed the mating force limit.

Fortunately, there have been developed a number of techniques to allow large numbers of pins to be mated. One of these methods is ZIF, which means that either small or almost no "Z-axis" forces are required to mate the connector. This typically is done in two basic ways. In one case the contacts are "normally open" and are cammed into contact position using an external plate. In other cases the contacts are "normally closed" and they are temporarily cammed open and then closed after insertion of a pin. Both of these designs share the problem of having sufficient contact "wipe⇆ to remove films and contaminants. Another method is to use some form of mechanical advantage to drive the pin assembly laterally into a contact, eliminating "Z-axis" forces and having sufficient contact wipe to maintain reliability. Typically, the mechanical advantage of a lever driving the pin assembly can reduce the mating forces to acceptable levels. However, historically these mechanisms have not been easy to design and implement. The designs typically have had problems with flexing and bowing resulting in hystersis in the connector assembly. Recent requirements of higher pin counts (600+ pins) coupled with changes of density from 0.100 centers to 0.050 centers, in addition to requirements for lower mating heights, make these problems even more difficult to solve.

SUMMARY OF THE INVENTION

In accordance with one embodiment of the present invention, an electrical connector is provided comprising electrical contacts and a housing. The electrical contacts are connected to the housing. The housing comprises a first housing member and a second housing member movably connected to the first housing member. The second housing member comprises holes for allowing terminals of an electrical component to be inserted into the housing. The housing also comprises contact preload projections. The contact preload projections engage the electrical contacts to preload the electrical contacts and, when the terminals are inserted into the holes, the contact preload projections contact the terminals to form a strain relief support for the terminals.

In accordance with another embodiment of the present invention, an electrical connector and electrical component assembly is provided comprising an electrical component comprising male contacts; and an electrical connector for connecting the electrical component to another electrical component. The electrical connector comprises electrical contacts and a housing. The housing comprises first and second housing members movably connected relative to each other. The electrical contacts are connected to the first housing member. The second housing member comprises contact preload sections contacting the electrical contacts and apertures having the male contacts therein. The contact preload sections having a width less than a width of the male contacts. The contact arms of the electrical contacts are deflected outward by the male contacts as the electrical contacts move off of the contact preload sections onto the male contacts.

In accordance with another embodiment of the present invention, an electrical connector is provided comprising electrical contacts and a housing. The housing comprises first and second housing members movably connected to each other. The electrical contacts are mounted to the first housing member. The second housing member comprising a first section and contact preload sections extending from the first section. The second housing member has apertures through the first section and into the contact preload sections. Side openings are provided at the contact preload sections into the apertures.

In accordance with one method of the present invention, a method of connecting male contacts to electrical contacts in an electrical connector is provided comprising steps of inserting the male contacts in a first direction into holes in a housing of the electrical connector; and moving the male contacts in a second different direction, with a portion of the housing, into contact with electrical contacts of the electrical connector. The electrical contacts are preloaded against preload sections of the portion of the housing, the preload sections having a width smaller than a width of the male contacts and, during the step of moving, the male contacts deflect contact arms of the electrical contacts outward as the electrical contacts move off of the preload sections onto the male contacts.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
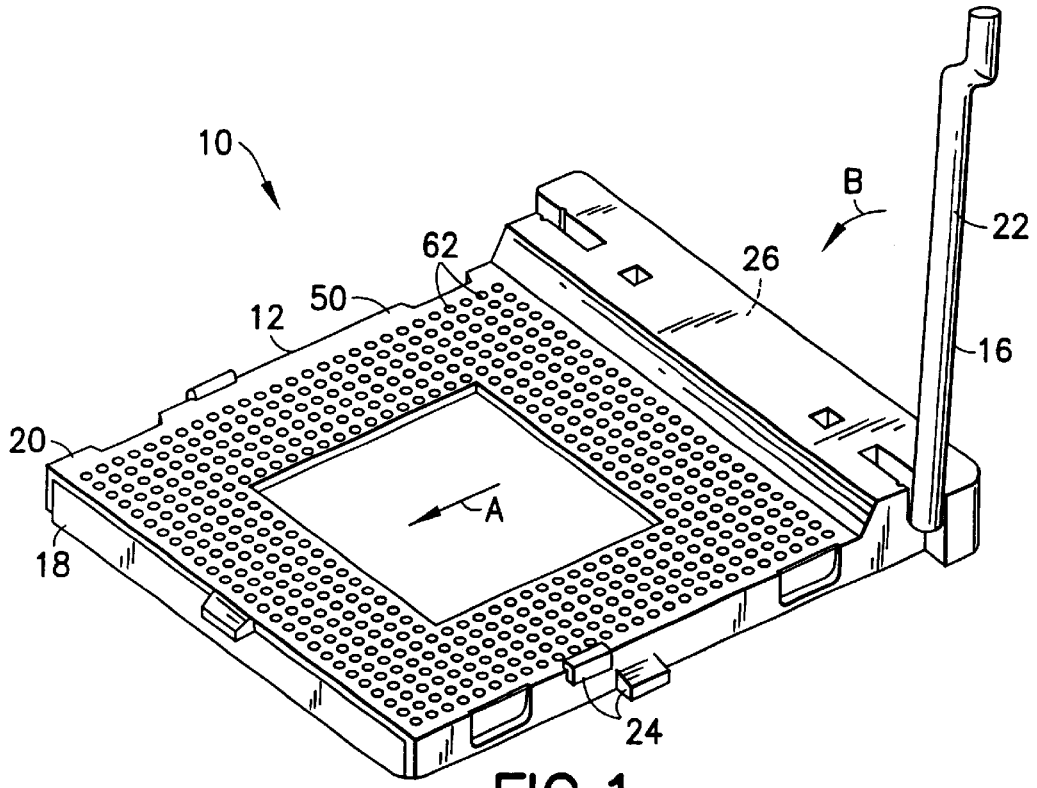
FIG. 1 is a perspective view of an electrical connector incorporating features of the present invention.

Referring to FIG. 1, there is shown a perspective view of an electrical connector 10, specifically a socket connector, incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Figure 2A:
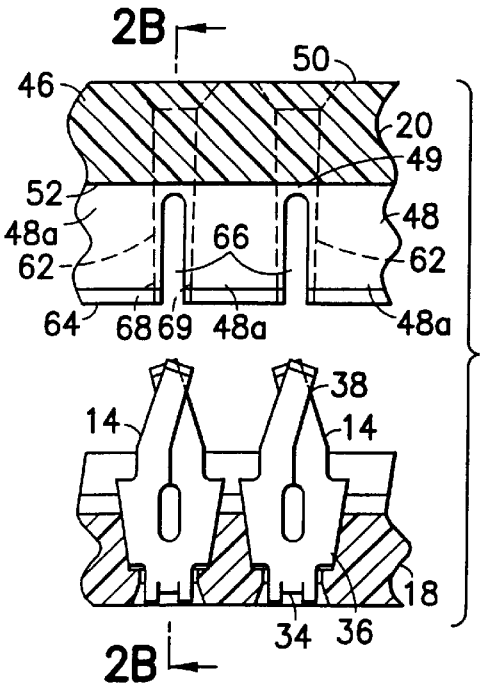
FIG. 2A is an enlarged exploded partial cross-sectional view of the connector shown in FIG. 1.
Figure 2B:
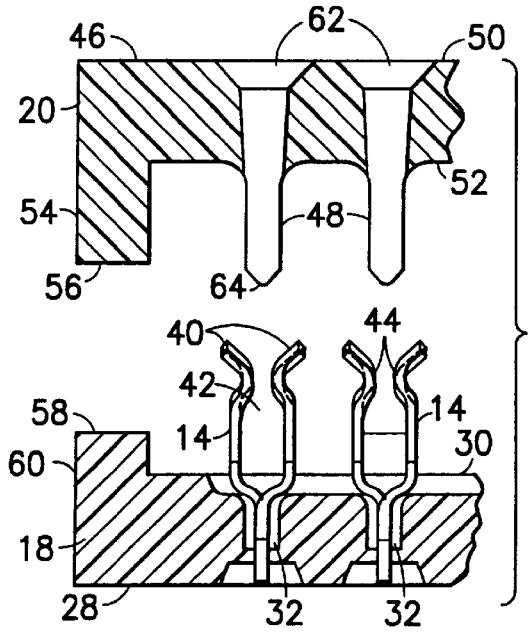
FIG. 2B is an exploded partial cross-sectional view of the connector shown in FIG. 2A taken along line 2B—2B.

The connector 10 generally comprises a housing 12, electrical contacts 14 (see FIGS. 2A and 2B), and a movement or actuation mechanism 16. The connector 10 is generally intended to connect an electrical component, such as a computer chip, pin grid array (PGA) component or multi-chip module to another electrical component, such as a printed circuit board. Similar connectors are disclosed in U.S. Pat. Nos. 5,704,800; 5,649,836; and 5,044,973 which are hereby incorporated by reference in their entireties. However, features of the connector 10 could be used to connect any suitable types of electrical or electronic components. Referring also to FIGS. 2A and 2B, enlarged, partial exploded views of the connector 10 are shown. The housing 12 generally comprises a relatively stationary base 18 and a movable cover 20. The cover 20 is movably mounted to the base and can move in the direction of arrow A in FIG. 1 between a first position shown in FIG. 1 and a second position. The movement mechanism 16 can comprise a cam lever 22. The cam lever 22 can be moved by a user in direction B from the position shown in FIG. 1 to a latched position between latches 24. The cam lever 22 has a camming surface 26 that cooperates with portions of the cover 20 and base 18 to move the cover relative to the base as the cam lever is moved. However, in alternate embodiments any suitable type of movement mechanism can be provided for moving the cover relative to the base. In another alternate embodiment, the movement mechanism could be adapted to move a third housing member (not shown) located between the base and cover; the third housing member having the contact preload sections and/or male contact strain relief described below.

The base 18 is preferably comprised of a dielectric material, such as a molded plastic or polymer material. However, any suitable material(s) could be used. The base 18 has a bottom side 28, a top side 30, and contact receiving areas 32 between the two sides. The bottom side 28 is adapted to be located adjacent an electrical component, such as a printed circuit board. The contacts 14 are fixedly connected to the base 18 in the areas 32. The contacts 14 are comprised of electrically conductive material, such as stamped and formed from a sheet of copper alloy. However, any suitable contacts could be provided and any suitable process(es) could be used to form the contacts. In this embodiment the contacts 14 each comprise a bottom end 34, a middle section 36, and a top end 38. The bottom ends 34 of the contacts 14 are located at the bottom side 28. The bottom ends 34 could have any suitable shape, such as a through-hole mounting solder tail, or a surface mounting solder tail, or could use a solder ball for surface mounting. However, any suitable contact end at the bottom of the contacts could be provided. The middle section 36 connects the contact 14 to the base 18 in the receiving area 32. The top end 38 generally comprises two opposing cantilevered contact arms 40. However, in an alternate embodiment, any suitable shape of the top ends 38 could be provided, such as only one cantilevered contact arm. In this embodiment the two contact arms 40 form a space or receiving area 42 between the two arms. In addition, the arms 40 have contact areas 44 located directly opposite each other. The contacts 14 are aligned in rows with their receiving areas 42 aligned in each row parallel to direction A.

The cover 20 is preferably comprised of dielectric material, such as molded plastic or polymer material. However, any suitable material(s) and process(es) for forming the cover could be used. The cover 20 includes a top section 46 and a plurality of contact preload sections 48. The top section 46 has a top side 50, a bottom side 52, and side platforms 54. The bottom surfaces 56 of the side platforms 54 could be located on the top surfaces 58 of the side platforms 60 of the base 18. However, any suitable movable engagement between the cover 20 and base 18 could be provided. The contact preload sections 48 extend or project downward from the bottom side 52. The cover 20 includes lead-in holes or apertures 62. The holes 62 extend through the top section 46 from the top side 50 and into the contact preload sections 48. In this embodiment the preload sections 48 each form individual preload portions 48*a* which preferably flank the contacts 14. The portions 48*a* are generally separated from each other by the holes 62 and openings 66, but with a connecting portion 49. However, in an alternate embodiment the portions 49 need not be provided, such as when the portions 48*a* are not directly connected to each other. The contact preload sections 48 each generally comprise a wedge shaped bottom tip 64, a substantially uniform width, a general elongate length and a general elongate height. In addition, the contact preload sections 48 also include lateral side openings or windows 66 on both opposite lateral sides of each preload section into each of the holes 62. The contact preload sections 48 are arranged in lines parallel with direction A. In this embodiment the holes 62 have a slight taper between walls 68, 69 towards the distal bottom end of the holes 62. However, in an alternate embodiment this taper need not be provided.

Figure 3B:
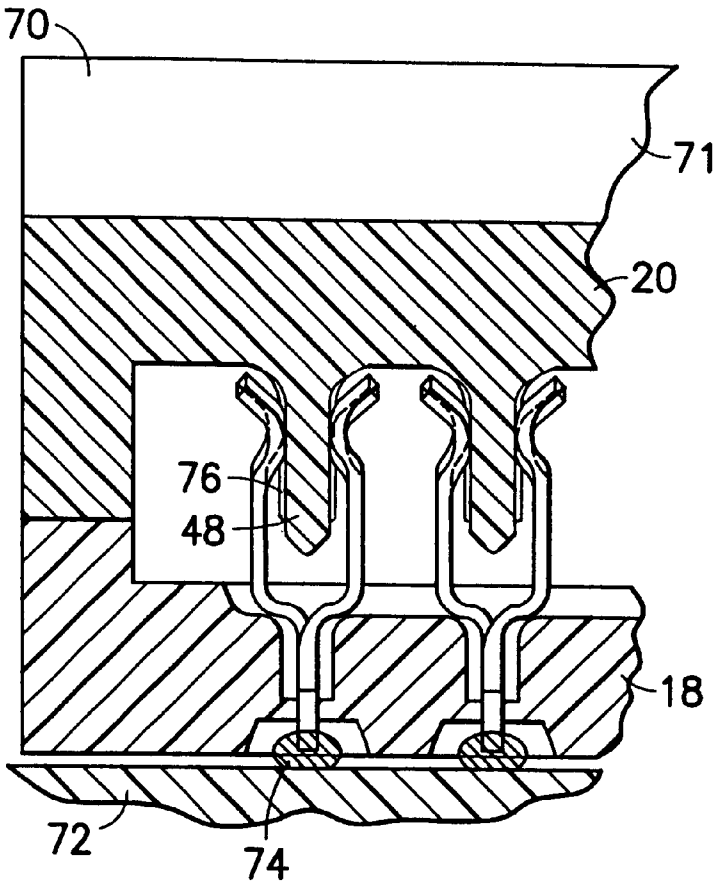
FIG. 3B is a partial cross-sectional view of the connector shown in FIG. 3A taken along line 3B—3B.
Figure 3A:
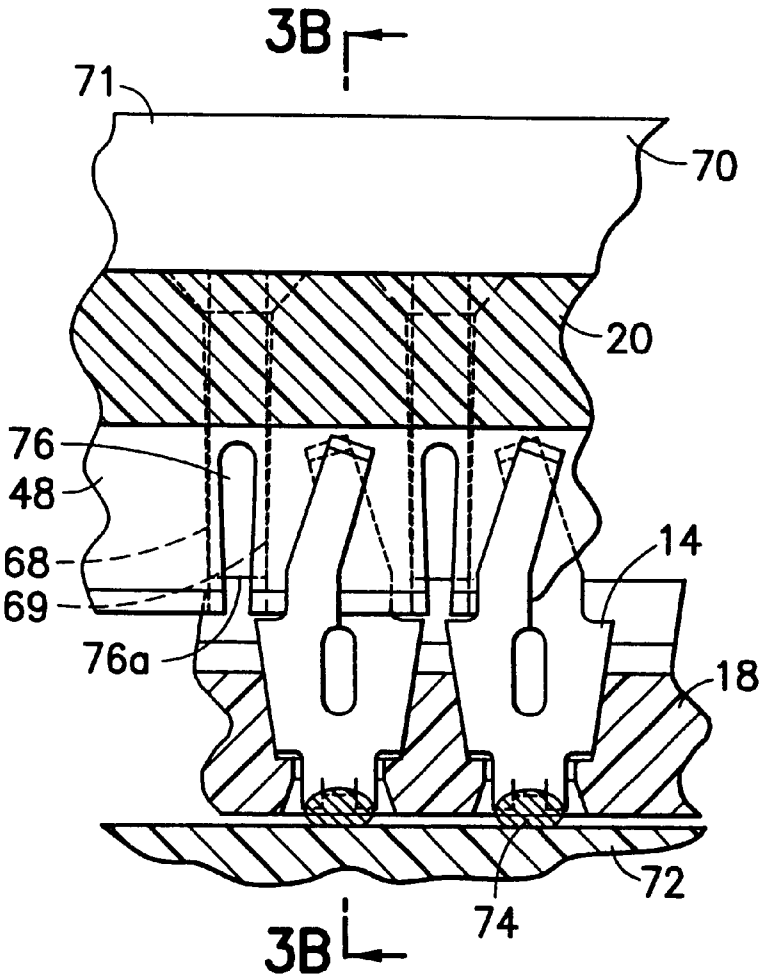
FIG. 3A is an enlarged partial cross-sectional view of the connector shown in FIG. 1 at a first position and connecting two electrical components to each other.
Figure 3C:
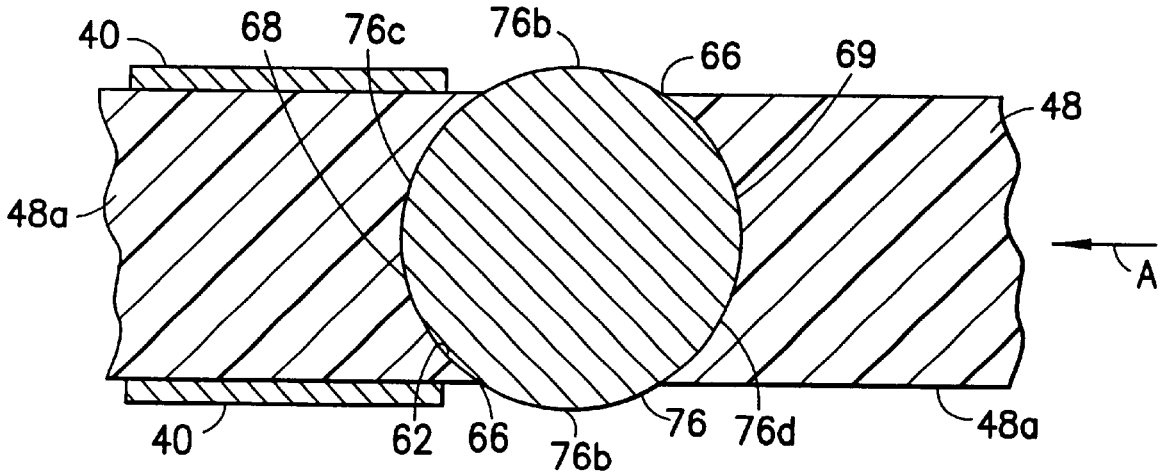
FIG. 3C is a partial cross-sectional view of two of the contacts and the preload section shown in FIG. 3A.

When the connector 10 is assembled, the cover 20 is typically snap fitted over the base 18. The wedge shaped tips 64 of the preload sections 48 help to wedge the pairs of contact arms 44 apart during the assembly of the cover 20 to the base 18. The cover 20 can slide relative to the base as indicated by arrow A when the cam lever 22 is moved down and in a reverse direction when the lever is moved up. FIGS. 3A and 3B show the connector 10 at a first position for connecting or removing the first electrical component 70 with the connector 10. In this first position the cover 20 is located relative to the base 18 such that the holes 62 and openings 66 are offset from the contact areas 44 of the contacts 14. The tail ends 34 of the contacts 14 are shown connected to a printed circuit board 72 by solder 74. When the cover 20 is connected to the base 18 and the cover and base are in their first relative position, the contact preload portions 48*a* are inserted between respective pairs of arms 40 of each contact 14 into areas 42. The contact preload sections 48 are wider than the space between contact areas 44. Therefore, the pairs of arms 40 are spread apart by the preload sections 48 and thereby preloaded against the lateral sides of the preload sections 48. With the connector 10 in the first position, the male contact pins 76 of the component 70 can be inserted into the holes 62 through the top surface 50 of the cover 20. As the pins 76 extend into the holes 62 they can be contacted by the opposing walls 68, 69. This causes the distal ends 76*a* of the pins 76 to be sandwiched between the two walls 68, 69. In the preferred embodiment, the walls 68, 69 only contact the distal ends 76*a* of the pins 76 to minimize frictional insertion forces of the pins into the holes 62. However, any suitable areas and lengths of contact between the pins 76 and walls 68 and/or 69 could be provided. In an alternate embodiment, the distal ends of the pins need not contact the walls 68 and/or 69 when inserted into the holes 62. Referring also to FIG. 3C, in this embodiment the pins 76 have a general circular cross-section. However, any suitable cross-sectional shape could be provided. In this embodiment the walls 68, 69 have curved surfaces to cooperatingly mate with the distal ends 76*a* of the pins 76. The pins 76 are wider than the preload sections 48. Thus, lateral sides 76*b* of the pins 76 extend out of the openings 66. When the pins 76 are inserted in the holes 62, contact with the walls 68, 69 slightly resists insertion, but only by a relatively small amount (e.g., a total of 10 pounds or less). The surfaces of the walls 68, 69 can be configured to reduce this initial insertion force to minimize frictional forces by reducing contact area, but still allow the walls 68, 69 to support the sides 76*c* and/or 76*d* of the pins 76. In an alternate embodiment only the one side 76*c* need contact the preload section 48. Alternatively, neither side 76*c* or 76*d* is contacted by the preload section 48; except perhaps as a spaced limit or stop surface to stop bending of the pins 76 at predetermined deformations. In the embodiment shown in FIG. 3C, the preload sections 48 provide a function of a strain relief for the pins 76. More specifically, the surfaces of the walls 68, 69 in the holes 62 limit bending of the pins 76 relative to the cover 20 and the main body 71 of the component 70 as the pins move into and out of contact with the electrical contacts 14. This reduces strain on the pins, such as on the solder joint connections of the pins 76 with the main body 71. Thus, there is less risk of damage to the component 70 at the connections between its pins and its main body. This could also allow the pins to have smaller cross-sectional shapes with no increase in pin deformation as the pins contact the electrical contacts in the connector 10. Thus, contact pitch or spacing between contact pins could be reduced.

Figure 4C:
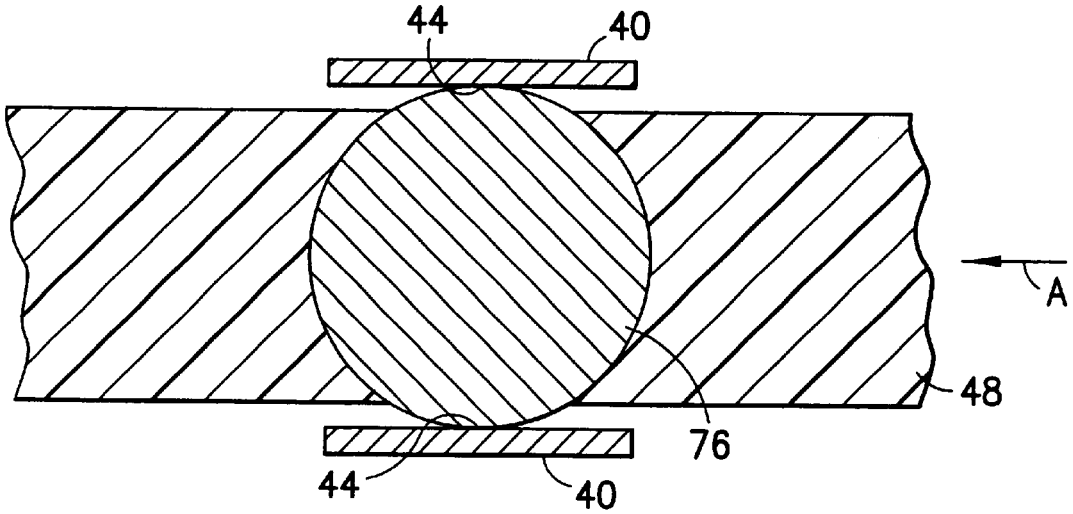
FIG. 4C is a partial cross-sectional view of two of the contacts and the preload section shown in FIG. 4A.
Figure 4B:
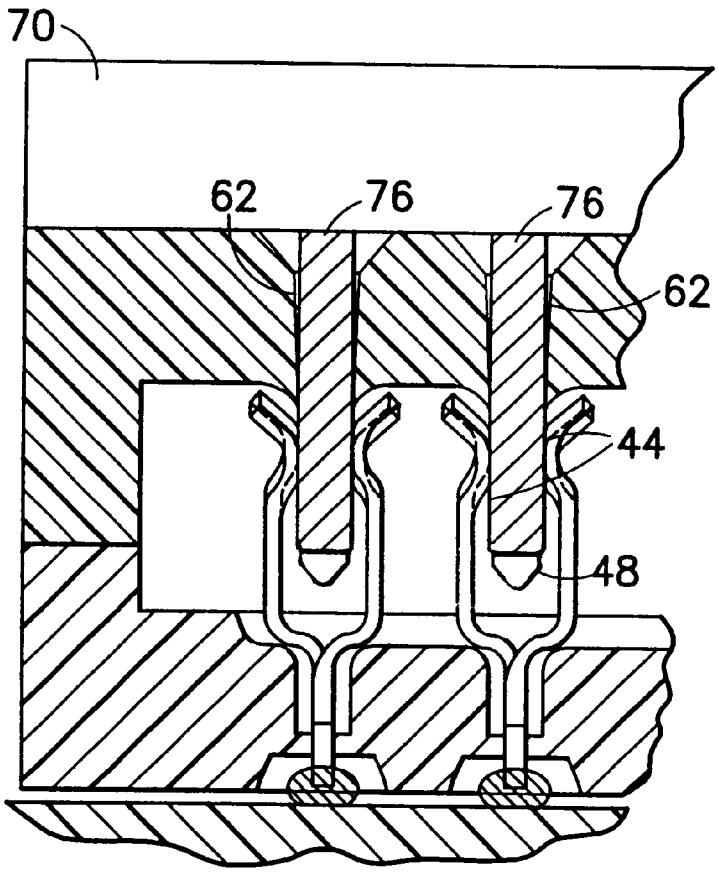
FIG. 4B is a partial cross-sectional view of the connector shown in FIG. 4A taken along line 4B—4B.
Figure 4A:
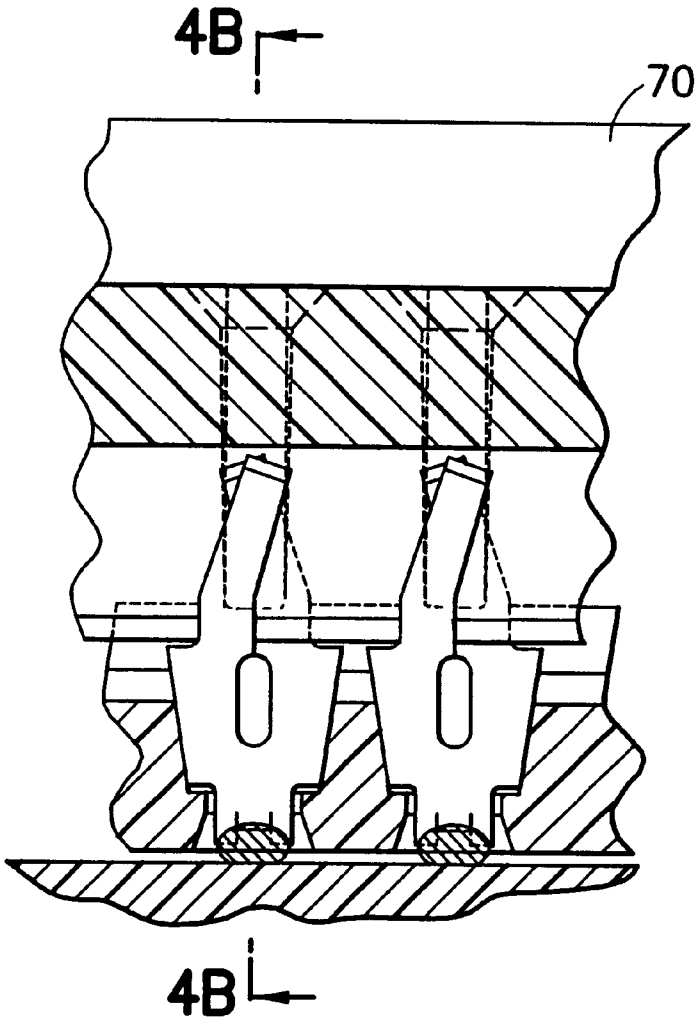
FIG. 4A is an enlarged partial cross-sectional view of the connector shown in FIG. 1 at a second position and connecting two electrical components to each other.

Referring now to FIGS. 4A and 4B, the connector 10 is shown at a second position wherein the cover 20 and the component 70 have been moved to a second position relative to the base 18. More specifically, when a user moves the lever 22 from the up position shown in FIG. 1 to a down position into the latches 24, the cover 20 is moved in direction A relative to the base 18. The component 70 is moved with the cover 20. As seen with reference to FIG. 4C, the pins 76 are moved into a position between respective pairs of arms 40 of the contacts 14. The contact areas 44 of the contacts 14 move off of the preload portions 48*a* and onto the sides 76*b* of the pins 76; the sides 76*b* extending out of the openings 66. Because the pins 76 are wider than the preload sections 48, the arms 40 are wedged or deflected outward when they contact the pins 76. Thus, the contact areas 44 and pins 76 wipe against each other. This contact wiping action ensures a good electrical connection between the contacts 76, 14. Since contacts 14 are preloaded, a reduced force is required to deflect contacts 14 with pins 76 than without preload portions 48*a*. This helps reduce stress build up in the housing 12 during actuation. Even with the preloading, a sufficient force is still exerted by the arms 40 against the pins 76.

The initial mating angle and the pin tip is preferably optimized. An approach to doing this, as described above, is to design a cover for the connector so that small elongated pillars of plastic are between the contact pins. These pillars are slightly smaller in width than the diameter of the pins. When the assembly is first inserted, the plastic pillars will be inserted between the tines of the contacts and will open them so that they are pre-loaded open. This means that there will be some z-axis force required to assemble the connector, but significantly less than that seen by a normal pin. The pin/cover assembly is then cammed into place, laterally contacting the receptacle contacts. These pillars have an additional function, since they will be also provided strain relief of the pin to prevent solder joint damage of the small diameter pin. Subsequent movement of the lever 22 to an up position will move the cover 20 and pins 76 back to the position shown in FIGS. 3A–3C to allow the component 70 to be removed if necessary.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector comprising:

electrical contacts; and a housing having the electrical contacts connected thereto, the housing comprising a first housing member and a second housing member movably connected to the first housing member, the second housing member comprising holes for allowing terminals of an electrical component to be inserted into the housing and further comprising contact preload projections, wherein the contact preload projections engage the electrical contacts to preload the electrical contacts and, when the terminals are inserted into the holes, the contact preload projections contact the terminals to form a strain relief support for the terminals, wherein the contact preload projections have a width which is less than a width of the holes and less than a width of the terminals.

2. An electrical connector as in claim 1 wherein the contact preload projections have first pin contact faces, facing a first direction of movement of the second housing member relative to the first housing member, for contacting the terminals when the terminals are inserted into the holes.

3. An electrical connector as in claim 2 wherein the contact preload projections have second pin contact faces, facing a second direction reverse to the first direction, for contacting the terminals when the terminals are inserted into the holes.

4. An electrical connector as in claim 1 wherein the electrical contacts each comprise opposing contact arms and the contact preload projections are located between the opposing contact arms.

5. An electrical connector as in claim 1 wherein the holes extend into the contact preload projections.

6. An electrical connector as in claim 5 wherein openings through lateral sides of the contact preload projections extend into the holes.

7. An electrical connector as in claim 6 wherein the openings are located on two opposite lateral sides of each contact preload projection.

8. An electrical connector as in claim 1 wherein the contact preload projections each comprise a wedge shaped distal tip, a substantially uniform width, an elongate length and an elongate height.

9. An electrical connector and electrical component assembly comprising:

an electrical component comprising male contacts; and an electrical connector for connecting the electrical component to another electrical component, the electrical connector comprising;

electrical contacts; and a housing comprising first and second housing members movably connected relative to each other, the electrical contacts being connected to the first housing member, the second housing member comprising contact preload portions contacting the electrical contacts, and apertures having the male contacts therein, the contact preload portions having a width less than a width of the male contacts, wherein contact arms of the electrical contacts are deflected outward by the male contacts as the electrical contacts move off of the contact preload portions onto the male contacts.

10. An assembly as in claim 9 wherein the contact preload portions each contact at least one side of a respective one of the male contacts.

11. An assembly as in claim 10 wherein at least some of the contact preload portions contact another side of a second respective one of the male contacts.

12. An assembly as in claim 9 wherein the apertures extend between pairs of the contact preload portions.

13. An assembly as in claim 9 wherein the contact preload portions are arranged in groups of parallel contact preload sections and wherein openings through lateral sides of the contact preload sections extend into the apertures.

14. An assembly as in claim 13 wherein the openings are located on two opposite laterals sides of each contact preload section.

15. An assembly as in claim 9 wherein the contact preload portions each comprise a wedge shaped distal tip, a substantially uniform width, an elongate length and an elongate height.

16. An electrical connector comprising:

electrical contacts; and a housing comprising first and second housing members movably connected to each other, the electrical contacts being mounted to the first housing member, and the second housing member comprising a first section and contact preload sections extending from the first section, the second housing member having apertures through the first section and into the contact preload sections, wherein side openings are provided at the contact preload sections into the apertures.

17. An electrical connector as in claim 16 wherein the side openings comprise pairs of the openings on opposite sides of the contact preload sections.

18. An electrical connector as in claim 16 wherein the contact preload sections have a width smaller than a width of the apertures.

19. An electrical connector as in claim 16 wherein contact preload sections each have a substantially uniform width and an elongate length.

20. An electrical connector as in claim 16 wherein the contact preload sections have surfaces for contacting distal portions of contact pins inserted into the apertures.

21. An electrical connector as in claim 20 wherein the surfaces are located for contacting opposite sides of each contact pin inserted into the apertures.

* * * * *